United States Patent [19]

Endo

[11] Patent Number: 4,886,998

[45] Date of Patent: Dec. 12, 1989

[54] ELECTRON GUN ELECTRODE FOR A COLOR PICTURE TUBE

[75] Inventor: Satoru Endo, Mobara, Japan

[73] Assignee: Hitachi, Ltd., Tokyo, Japan

[21] Appl. No.: 147,988

[22] Filed: Jan. 25, 1988

[30] Foreign Application Priority Data

| | | | |
|---|---|---|---|
| Jan. 26, 1987 | [JP] | Japan | 62-14022 |
| Jan. 26, 1987 | [JP] | Japan | 62-14021 |
| Mar. 20, 1987 | [JP] | Japan | 62-63797 |

[51] Int. Cl.[4] ..... H01J 29/48; H01J 29/02

[52] U.S. Cl. ..... 313/414; 313/447; 313/448

[58] Field of Search ..... 313/414, 447, 448

[56] References Cited

U.S. PATENT DOCUMENTS

| | | | |
|---|---|---|---|
| 3,767,953 | 10/1973 | Bossers | 313/447 |
| 4,251,747 | 2/1981 | Burdick | 313/414 X |
| 4,628,224 | 12/1986 | Collins et al. | 313/414 |

FOREIGN PATENT DOCUMENTS 157936 7/1984 Japan .

*Primary Examiner*—Palmer C. DeMeo

*Attorney, Agent, or Firm*—Antonelli, Terry & Wands

[57] ABSTRACT

An electrode of a color picture tube electron gun with a recess provided on the periphery of an electron beam pass aperture, characterized in that the electrode has a thickness of 0.4 to 1.0 times the diameter of the electron beam pass aperture at the portion at which the recess is to be formed and a thickness of 0.1 to 0.2 times the diameter of the electron beam pass aperture at the recessed portion, and the sheet material for the electrode is subjected to plastic working so that the recess forming surface has a thickness of 25 to 50% the thickness of the sheet material or a projection and/or a groove having a section with steeply inclined side portions is provided on both sides of the recess at least in the direction of the width of the recess approximate to the diameter of the electron beam pass aperture.

3 Claims, 4 Drawing Sheets

ELECTRON GUN ELECTRODE FOR A COLOR PICTURE TUBE

BACKGROUND OF THE INVENTION

1. Field of the Invention

The present invention relates to an electrode of an in-line type color picture tube electron gun and, more particularly, to an electrode suitable for improving the focus characteristic on the periphery of a screen.

2. Description of the Prior Art

An example of conventional electron guns for improving the focus characteristic at the peripheral parts of the screen of a color picture tube is disclosed in Japanese Pat. Laid-Open No. 157936/1984. This electron gun has a structure in which a slit recess is provided on the periphery of an electron beam pass aperture of a second grid electrode, the electrode being so designed as to have a thickness larger in the vertical deflection direction and smaller in the horizontal deflection direction, so that the divergent angle of the electron beam is reduced in the vertical deflection direction. The thickness of the electrode is set at 0.45 to 1.0 times the diameter of the electron beam passage aperture at the portion at which the recess is to be formed and at 0.2 to 0.4 times the diameter of the electron beam passage aperture at the recessed portion.

This prior art has no problem in the color picture tube having a screen size of less than 20", but if the color picture ray tube has a screen of 20" or more, e.g., a super large-sized screen of 33", it is impossible to obtain the highly accurate focus characteristic.

The above-described recess, e.g., a recess 3 shown in FIGS. 5(*a*) and 5(*b*), are generally formed by coining, as disclosed in, for example, Japanese Pat. Publication No. 4550/1965. In FIGS. 5(*a*) and 5(*b*), the reference numeral 4 represents an annular projection.

When an electrode 1 shown in FIGS. 5(*a*) and 5(*b*) is fabricated, an excess metal absorb hole 5 is first provided at the portion which corresponds to an electron beam pass aperture 2, as shown in FIGS. 6(*a*) and 6(*b*), in order to reduce the coining force, as disclosed in Japanese Pat. Publication No. 4550/1965. A recess 3 is then formed on a recess forming surface 6 on the periphery of the excess metal absorb hole 5 by coining, as shown in FIGS. 7(*a*) and 7(*b*), so that the excess metal absorb hole 5 is reduced in size, as indicated by the reference numeral 7. Thereafter, the excess metal absorb hole 7 is formed into a predetermined electron beam pass aperture 2.

In the above-described prior art, the excess metal inevitably produced when coining the recess 3 flows in the direction of both a plastic flow 8 toward the absorb hole contracting direction and a plastic flow 9 toward a projection 4, as shown in FIG. 7(*b*). The plastic flow 9 toward the projection 4 is absorbed in the transformed shape, as indicated by the broken line 10, but causes an irregular roundness, in other words, a defect around the entire periphery of the opening 11 of the recess 3. The size of the defect is irregular on the periphery of the recess 3, which fact leads to nonuniformity in the configurative accuracy. In particular, the configuration of the recess 3 in the vertical deflection direction (direction of y) in the vicinity of the electron beam pass aperture 2 matters in producing a step on the recess 3 in the vicinity of the aperture 3 in FIG. 5.

As described above, since the prior art involves the problem of nonuniformity in the configurative accuracy of the recess in the vertical deflection direction, it is impossible to obtain uniformity in the focus characteristic on the color picture tube.

When an electrode 1 shown in FIGS. 10(*a*) and 10(*b*) is fabricated, an excess metal absorb hole 5 is first provided at the portion which corresponds to an electron beam pass aperture 2, as shown in FIGS. 11(*a*) and 11(*b*), in order to reduce the coining force, as disclosed in Japanese Pat. Publication No. 4550/1965. A recess 3 is then formed on a recess forming surface 6 on the periphery of the excess metal absorb hole 5 by coining, as shown in FIGS. 12(*a*) and 12(*b*), so that the excess metal absorb hole 5 is reduced in size, as indicated by the reference numeral 7. Thereafter, the excess metal absorb hole 7 is formed into a predetermined electron beam pass aperture 2.

In the above-described prior art, the excess metal inevitably produced when coining the recess 3 flows in the directions of both a plastic flow 8 toward the absorb hole contracting direction and a plastic flow 9 toward a projection 4, as shown in FIG. 12(*b*). The plastic flow 9 toward the projection 4 is absorbed in the transformed shape, as indicated by the broken line 10, but causes an irregular roundness, in other words, a defect around the entire periphery of the opening 11 of the recess 3. The size of the defect is irregular on the periphery of the recess 3, which fact leads to nonuniformity in the configurative accuracy. In particular, the configuration of the recess 3 in the vertical deflection direction (direction of y) in the vicinity of the electron beam pass aperture 2 matters in producing a step on the recess 3 in the vicinity of the aperture 3 in FIG. 10.

As described above, since the prior art involves the problem of nonuniformity in the configurative accuracy of the recess in the vertical deflection direction, it is impossible to obtain uniformity in the focus characteristic on the color picture tube.

SUMMARY OF THE INVENTION

Accordingly, it is a primary object of the present invention to provide an electrode of a color picture tube electron gun which is capable of providing a highly accurate focus characteristic for even a large-sized color picture tube.

It is a secondary object of the present invention to prevent the generation of a defect during manufacture of an electrode and to provide an electrode of a color picture tube electron gun which has a high uniformity in the configurative accuracy of a recess.

To achieve this aim, the present invention provides an electrode of a color picture tube electron gun with a recess provided on the periphery of an electron beam pass aperture, characterized in that the electrode has a thickness of 0.4 to 1.0 times the diameter of the electron beam pass aperture at the portion at which the recess is to be formed and a thickness of 0.1 to 0.2 times the diameter of the electron beam pass aperture at the recessed portion, and the sheet material for the electrode is subjected to plastic working so that the recess forming surface has a thickness of 25 to 50% the thickness of the sheet material or a projection and/or a groove having a section with steeply inclined side portions is provided on both sides of the recess at least in the direction of the width of the recess approximate to the diameter of the electron beam pass aperture.

The foregoing and other objects, advantages, manner or operation and novel features of the present invention will be understood from the following detailed description when read in connection with the accompanying drawings.

BRIEF DESCRIPTION OF THE DRAWINGS

FIG. 1(*b*) is a sectional view thereof;

FIGS. 2(*a*) and 2(*b*) show the second grid electrode, wherein

FIG. 2(*a*) is an elevational view thereof; and

FIG. 2(*b*) is a sectional view thereof;

FIG. 4(*b*) is a sectional view thereof;

FIG. 5(*b*) is a sectional view thereof;

FIGS. 6(*b*) and 7(*b*) are sectional views thereof;

FIG. 8(*b*) is a sectional view thereof;

FIG. 10(*b*) is a sectional view thereof; FIGS. 11(*b*) and 12(*b*) are sectional views thereof.

DESCRIPTION OF THE PREFERRED EMBODIMENTS

[First Embodiment]

The thickness of the recessed portion provided on the periphery of the electron beam pass aperture is 0.1 to 0.2 times the diameter of the electron beam pass aperture. Thus, since the depth of the recess is large, the divergent angle of the electron beam in the horizontal deflection direction is much larger than the divergent angle in the vertical deflection direction. The focus characteristic is therefore improved even in a large-sized color picture tube.

Figure 1A:
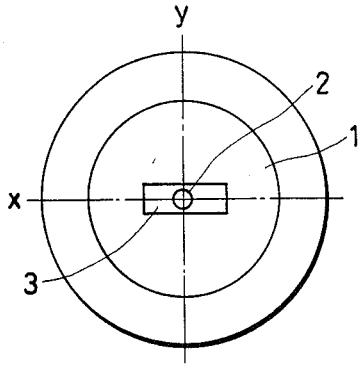
FIGS. 1(*a*) and 1(*b*) show the electron beam pass aperture of a first embodiment of a second grid electrode according to the present invention, wherein FIG. 1(*a*) is an enlarged elevational view thereof.
Figure 2A:
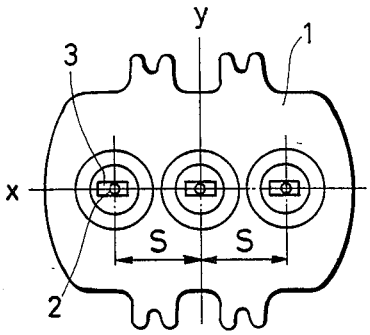
Figure 2B:
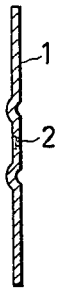
Figure 1B:
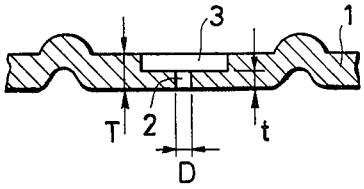

A first embodiment of the present invention will be explained hereinunder with reference to FIGS. 1 and 2. A second grid electrode 1 is provided with three electron beam pass apertures 2 arranged in alignment. A slit recess 3 longitudinal in the direction of x (in the horizontal deflection direction) 3 is formed on the periphery of the electron beam pass aperture 2. If the diameter of the electron beam pass aperture is represented by D, the thickness T of the electrode at the portion at which the recess 3 is to be formed is set at (0.4 to 1.0)D and the thickness t of the recessed portion is set at (0.1 to 0.2)D.

Since the thickness t of the recessed portion is as thin as (0.1 to 0.2)D and, hence, the depth of the recess 3 is so large, the divergent angle of the electron beam in the horizontal deflection direction (direction of x) is much larger than the divergent angle in the vertical deflection direction (direction of y). The focus characteristic is therefore improved.

The following electrodes were made on experiment. In a color picture tube having a neck diameter of 29 mm$\phi$, when the distance S between the adjacent ones of the three electron beam pass apertures 2 was 6.6 mm and the diameter D of the electron beam pass aperture 2 was 0.67 mm, the electron was so fabricated that T=0.30 mm (=0.45 D) and t =0.13 mm (=0.2 D). When S=5.5 mm and D=0.64 mm, the electron was so fabricated that T=0.26 mm (=0.4 D) and t=0.10 mm (=0.15 D). In both cases, very good results were obtained.

Figure 3A:
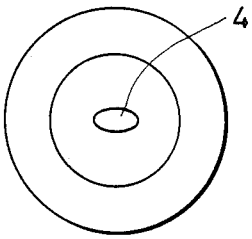
FIGS. 3(*a*) to 3(*c*) are sectional views of the second grid electrode shown in FIGS. 1 and 2, showing an example of a method of fabricating the electrode.
Figure 3B:
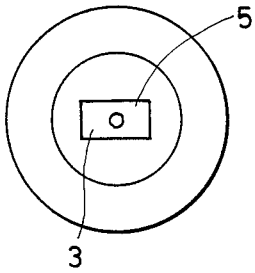
Figure 3C:
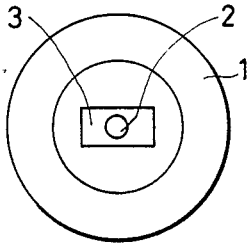

A second grid electrode 1 having a recess 3 with a large depth as those described above is fabricated, for example, by the process shown in FIGS. 3(*a*) to 3(*c*). An elliptical excess metal absorb hole 4 having the major axis in the longitudinal direction of the slit recess 3 is first formed, as shown in FIG. 3(*a*). The slit recess 3 is next formed by coining, as shown in FIG. 3(*b*). At this time, the excess metal absorb hole 4 is contracted by coining in the longitudinal direction of the slit recess 3, namely, mainly in the direction of the major axis of the excess metal absorb hole 4, resulting in an absorb hole 5 having an approximately circular configuration. Thereafter, the absorb hole 5 is formed into a predetermined electron beam pass aperture 2.

As described above, since the absorb hole 5 after coining has an approximately circular configuration, when the electron beam pass aperture 2 is formed, no defect is produced on the periphery of the aperture 2. The size of the elliptical excess metal absorb hole 4 provided in advance may be set within a range that allows the electron beam pass aperture 2 to be formed after coining, so that it is possible to make the area of the hole adequately large as compared with a conventional circular excess metal absorb hole, thereby reducing the coining force and, hence, prolonging the life of a coining tool.

According to this embodiment, since the electrode has a thickness of 0.4 to 1.0 times the diameter of the electron beam pass aperture at the portion at which the recess is to be formed and a thickness, for example, a uniform thickness of 0.1 to 0.2 times the diameter of the electron beam pass aperture at the recessed portion, a highly accurate focus characteristic is obtained even in a large-sized color picture tube.

[Second embodiment]

The secondary object of the present invention is achieved by making the recess forming surface of an electrode as thin as 25 to 50% of the thickness of a sheet material for the electrode by plastic working.

When the sheet material for the electrode is subjected in advance to coining so that the recess forming surface has a uniform and small thickness, the recess forming surface is strain hardened by the plastic working, thereby increasing the working deformation resistance. As a result, the plastic flow of the excess metal, which may cause a defect during the formation of the recess, is regulated, thereby increasing the configurative accuracy of the recess.

Figure 4A:
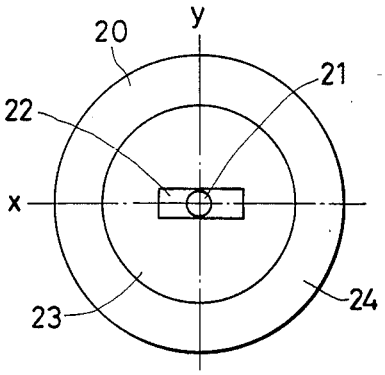
FIGS. 4(*a*) and 4(*b*) show the electron beam pass aperture of a second embodiment of a second grid electrode according to the present invention, wherein FIG. 4(*a*) is an enlarged elevational view thereof.
Figure 4B:
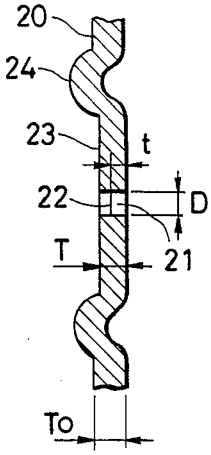
Figure 5A:
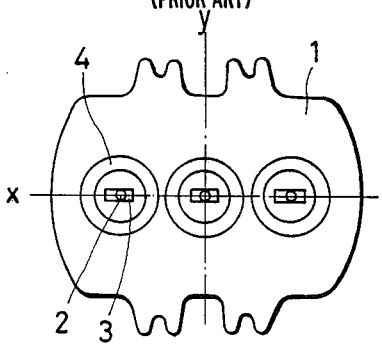
FIG. 5(a) (PRIOR ART)
FIGS. 5(*a*) and 5(*b*) show a conventional second grid electrode, wherein FIG. 5(*a*) is an elevational view thereof.
Figure 5B:
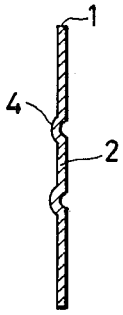
FIG. 5(b) (PRIOR ART)
Figure 6A:
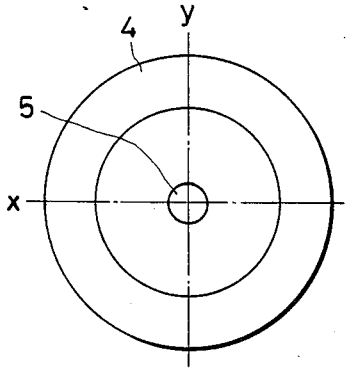
FIG. 6(a) (PRIOR ART)
FIGS. 6(*a*), 6(*b*), 7(*a*) and 7(*b*) show a method of fabricating the conventional second grid shown in FIGS. 5(*a*) and 5(*b*), wherein FIGS. 6(*a*) and 7(*a*) are enlarged elevational views thereof.
Figure 6B:
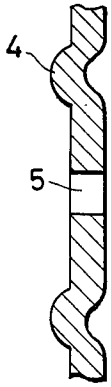
FIG. 6(b) (PRIOR ART)
Figure 7A:
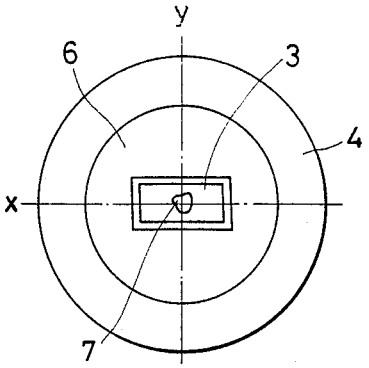
FIG. 7(a) (PRIOR ART)
Figure 7B:
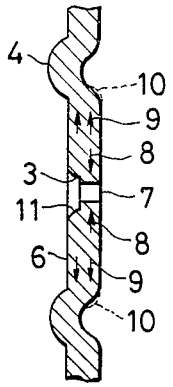
FIG. 7(b) (PRIOR ART)

A second embodiment of the present invention will be explained in the following with reference to FIGS. 4(*a*) and 4(*b*). A second grid electrode 20 is provided with a slit recess 22 on the periphery of an electron beam pass, aperture 21, and an annular projection 24 is provided on the periphery of the recess 22 of a recess forming surface 23. The thickness T of the recess forming surface 23 is in advance reduced to 25 to 50% of the thickness $T_0$ of a sheet material for the electrode 1 by coining.

The diameter D of the electron beam pass aperture 21 is slightly different by the use of a color picture tube, but it is generally set at about 0.4 to 0.8 mm. The thickness t of the recessed portion, namely, in the horizontal deflection direction (direction of x) is set at (0.2 to 0.4)D and the thickness T of the recess forming surface 23, namely, in the vertical deflection direction (direction of y) as set at (0.4 to 1)D. Both the thicknesses t and T are selected in accordance with the main lens system.

In this embodiment, a sheet material for the electrode having a thickness $T_0$ of 0.45 mm was subjected to coining so that the recess forming surface 23 had a thickness T of 0.3 mm. The material was next subjected to coining so that the thickness t of the recessed portion became 0.15 mm. The electron beam pass aperture 21 was formed so as to have a diameter D of 0.5 mm.

In this manner, as a result of reducing the thickness of the recess forming surface 23 from 0.45 mm to 0.3 mm before forming the recess 22, in other words, as a result of reducing the thickness at the working ratio of 33%, no defect was produced and the configurative accuracy of the recess was therefore greatly improved.

When the thickness of the sheet material for the electrode was 0.4 mm, and the recess forming surface 23 was made thin so as to have a thickness of 0.3 mm, in other words, as a result of reduction of the thickness at the working ratio of 25%, the configurative accuracy was slightly lower than that of the electrode fabricated at the working ratio of 33% but was satisfactory for maintaining the uniformity in the focus characteristic of the color picture tube. If the working ratio exceeds 50%, the working area of the recess forming surface becomes larger than that of the slit portion, thereby involving a problem in the wear of the tool and strength. It is therefore necessary that the working ratio is not more than 50%.

According to this embodiment, since the sheet material for the electrode is subjected to coining so as to make the recess forming surface thin at the working ratio of 25 to 50%, the recess forming surface is strain hardened. As a result, the plastic flow of the excess metal during the formation of the recess is regulated, thereby producing the uniformity in the configurative accuracy of the recess and enhancing the uniformity in the focus characteristic.

[Third embodiment]

The above-described secondary object of the present invention is also attained by replacing an annular projection having a semicircular section, which is generally provided on the periphery of the electron beam pass aperture, with an annular projection having a section with vertical side portions.

The annular projection having a section with vertical side portions is effective for regulating the plastic flow of the excess metal toward the projection which may cause a defect during the coining of the recess. Consequently, the plastic flow of the excess metal is concentrated in the direction in which the excess metal absorb hole is contracted, thereby preventing the generation of an irregular roundness produced around the opening of the recess in the prior art and producing a uniform and high configurative accuracy of the recess.

Figure 8A:
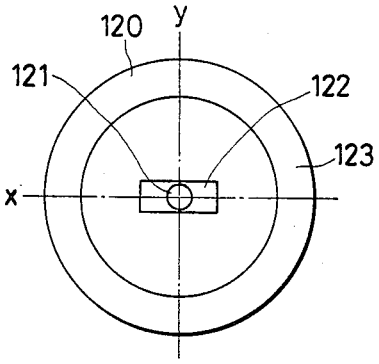
FIGS. 8(*a*) and 8(*b*) show the electron beam pass aperture of a third embodiment of a second grid electrode according to the present invention, wherein FIG. 8(*a*) is an enlarged elevational view thereof.
Figure 8B:
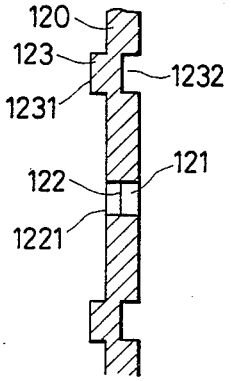

A third embodiment of the present invention will be explained with reference to FIGS. 8(*a*) and 8(*b*). A second grid electrode 120 is provided with a recess 122 on the periphery of an electron beam pass aperture 121, so that the thickness of the peripheral part of the electron beam pass aperture 121 is made smaller in the horizontal deflection direction (direction of x) and larger in the vertical deflection direction (direction of y). An annular projection 123 having a section with vertical side portions is formed around the recess 122 by half blanking.

Figure 9A:
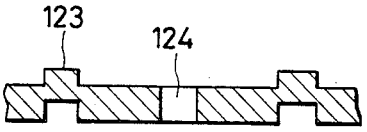
FIGS. 9(*a*) and 9(*b*) are sectional views of the second grid electrode shown in FIGS. 8(*a*) and 8(*b*) showing an example of a method of fabricating the electrode.
Figure 9B:
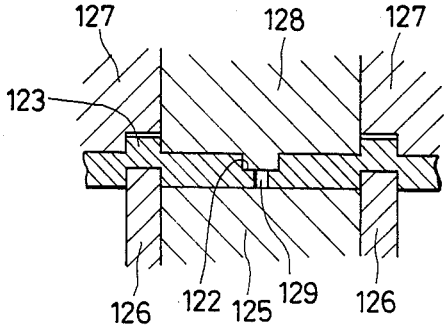
Figure 10A:
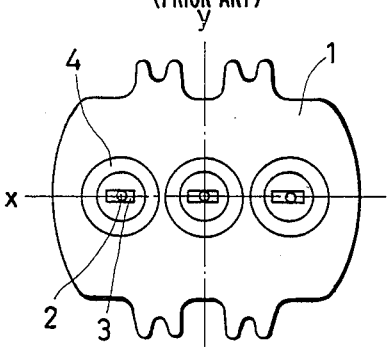
FIG. 10(a) (PRIOR ART)
FIGS. 10(*a*) and 10(*b*)show another conventional second grid electrode, wherein FIG. 10(*a*) is an elevational view thereof.
Figure 10B:
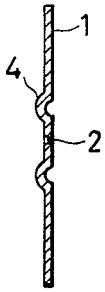
FIG. 10(b) (PRIOR ART)
Figure 11A:
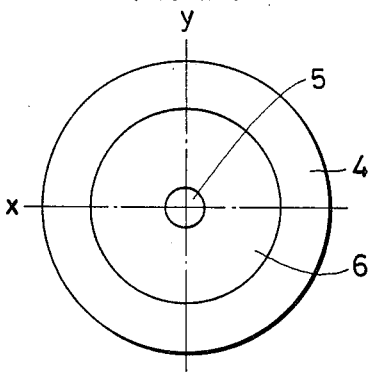
FIG. 11(a) (PRIOR ART)
FIGS. 11(*a*), 11(*b*), 12(*a*) and 12(*b*) show a method of fabricating the conventional second grid shown in FIGS. 10(*a*) and 10(*b*), wherein FIGS. 11(*a*) and 12(*a*) are enlarged elevational views thereof.
Figure 11B:
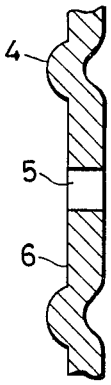
FIG. 11(b) (PRIOR ART)
Figure 12A:
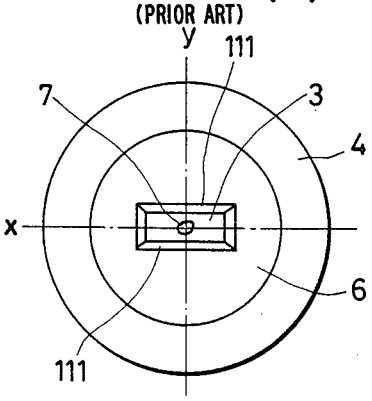
FIG. 12(a) (PRIOR ART)
Figure 12B:
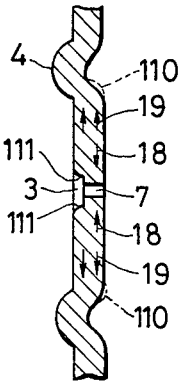
FIG. 12(b) (PRIOR ART)

The second grid electrode 120 having the above-described structure is fabricated by the process shown in FIGS. 9(*a*) and 9(*b*). The annular projection 123 having a section with vertical side portions is first formed by half blanking, as shown in FIG. 9(*a*). An excess metal absorb hole 124 is formed at the portion which, corresponds to the electron beam pass aperture 121. The thus-obtained semi-finished electrode is placed on a die 125 and guides 126. Guides 127 are lowered from the above to clamp the projection 123 between the guides 126 and 127. A punch 128 is lowered in this state to form the recess 122 by coining, whereby the excess metal absorb hole 124 is reduced in size as indicated by the reference numeral 129. The predetermined electron beam pass aperture 121 is finally formed to obtain the second grid electrode 120 shown in FIGS. 8(*a*) and 8(*b*).

In this manner, by forming the projection 123 so as to have a section with vertical side portions, it is easy to clamp the convex side 1231 and concave side 1232 of the projection 123 between the guides 127 and 128 over the entire periphery during the coining of the recess 122, thereby regulating the plastic flow of the excess metal toward the projection 123 which would cause a defect in the opening 1221 of the recess 122 in the prior art, and concentrating the plastic flow in the direction in which the excess metal absorb hole 124 is contracted. As a result, the recess 123 is formed at a uniform and high configurative accuracy.

According to the present invention, since an annular projection having a section with vertical side portions is formed on the periphery of the recess by half blanking, it is possible to regulate the plastic flow of the excess metal in the direction in which a defect is produced, thereby increasing the configurative accuracy of the recess and providing high uniformity in the focus characteristic of the color picture tube.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. An electrode of a color picture tube electron gun with a slit recess provided on the periphery of an electron beam pass aperture, characterized in that said recess is rectangularly formed on one surface of said electrode, the edges of said recess being stepped perpendicularly from said one surface, and the thickness of said electrode is 0.4 to 1.0 times the diameter of said electron beam pass aperture at the portion at which said recess is to be formed and the thickness of said recess is uniform and 0.1 to 0.2 times the diameter of said electron beam pass aperture.

2. An electrode of a color picture tube electron gun according to claim 1, wherein said electrode further includes on surfaces of said electrode surrounding said recess, a projection and a groove for guiding tools for making said recess.

3. An electrode of a color picture tube electron gun according to claim 2, wherein said projection and groove is an annular projection and groove having a section with vertical side portions.

* * * * *